US005636671A

United States Patent [19]

Harris et al.

[11] Patent Number: 5,636,671

[45] Date of Patent: Jun. 10, 1997

[54] VAPOR RECOVERY FUEL NOZZLE DEFLECTOR

[76] Inventors: David J. Harris, 140 W. 4th St., Roanoke, Ind. 46783; Thomas L. Claussen, 6825 Ramblewood Dr., Apt. H, Fort Wayne, Ind. 46835; John J. VanDaele, 10627 Oak Trail Rd., Fort Wayne, Ind. 46845

[21] Appl. No.: 396,655

[22] Filed: Mar. 1, 1995

[51] Int. Cl.[6] ..... B65B 1/04

[52] U.S. Cl. ..... 141/392; 141/97; 141/368

[58] Field of Search ..... 141/392, 97, 206, 141/368, 388, 59, 207, 208, 209, 210, 211, 212, 213, 214, 215, 216, 217, 218, 312, 367, 382, 383; 285/236

[56] References Cited

U.S. PATENT DOCUMENTS

| | | | |
|---|---|---|---|
| 2,214,708 | 9/1940 | Mayne et al. | 141/396 |
| 3,016,928 | 1/1962 | Brandt | 141/45 |
| 3,581,782 | 6/1971 | Onufer . | |
| 3,710,830 | 1/1973 | Gilson | 141/93 |
| 3,718,351 | 2/1973 | Bakkerus | 285/236 |
| 3,840,055 | 10/1974 | Wostl et al. . | |
| 3,899,009 | 8/1975 | Taylor . | |
| 4,003,415 | 1/1977 | Lasater | 141/392 |
| 4,004,621 | 1/1977 | Weidenaar et al. | 141/392 |
| 4,166,485 | 9/1979 | Wokas . | |
| 4,197,883 | 4/1980 | Mayer . | |
| 5,186,221 | 2/1993 | Ellis . | |
| 5,301,721 | 4/1994 | Hartmann . | |
| 5,365,985 | 11/1994 | Todd et al. | 141/392 |

*Primary Examiner*—David J. Walczak
*Attorney, Agent, or Firm*—Ice Miller Donadio & Ryan

[57] ABSTRACT

A fuel vapor entrapment device, during fueling of a motor vehicle fuel tank, traps escaping fuel vapors so as to enhance vacuum-assisted vapor recovery system operation. By deflecting fuel vapors and capturing them temporarily until their removed to a vapor storage tank, the device substantially prevents the escape of fuel vapor into the atmosphere and enables the vapor recovery system to capture a higher percentage of escaping fuel vapor. During the fueling process, the fuel entrapment device encircles the vehicle tank filler port, thereby forming a vapor containment area from which fuel vapors are removed, and prevents the ingestion of excessive ambient air into the vapor recovery system. A vacuum relief hole permits the ingestion of a limited amount of ambient air so as to prevent the build up of excessive negative pressure and avert vehicle fuel tank collapse during vacuum-assisted vapor recovery operation.

7 Claims, 2 Drawing Sheets

VAPOR RECOVERY FUEL NOZZLE DEFLECTOR

BACKGROUND OF THE INVENTION

The present invention relates generally to vapor recovery systems used in conjunction with liquid fuel dispensing equipment for refueling motor vehicles. More particularly, the invention relates to a fuel vapor entrapment device as attached to a fuel dispensing nozzle for assisting fuel vapor recovery during vehicle refueling.

The liquid fuel dispensing equipment found in most common service stations includes a fuel storage tank, a fuel dispenser means, a fuel delivery hose and a fuel dispensing nozzle. During the refueling process, liquid fuel is dispensed from the fuel dispensing nozzle into the vehicle fuel tank causing fuel vapor to be displaced out of the tank and into the atmosphere. Due to environmental concerns associated with such escaping fuel vapor, many governmental bodies require and many suppliers provide fuel vapor recovery systems which collect escaping fuel vapor and deliver the same into a fuel dispensing tank or into a separate vapor recovery tank.

Previous vapor recovery systems incorporated a boot/bellows device which was attached to a fuel dispensing nozzle for collecting escaping fuel vapor and which was in direct communication with a separate fuel vapor recovery line. Such prior art boot/bellows type devices are shown in U.S. Pat. Nos. 3,840,055 (Wostl et al), 3,581,782 (Onufer) and 4,197,883 (Mayer). Such boot/bellows type devices were commonly used in prior art "balanced" vapor recovery systems which relied on the incoming fuel to displace and force the fuel vapors out of the vehicle fuel tank and into and through the vapor recovery system. In a balanced vapor recovery system, a completely closed or sealed equal volume displacement and exchange system is provided for delivering liquid fuel and for capturing and returning fuel vapors to the original fuel dispensing source.

One of the problems associated with the bellows/boot type devices is that they are quite large and cumbersome and generally have a series of predetermined hinge points essential for proper connection to the vehicle fuel tank fill port. Due to the high rate of refueling associated with modern fuel dispensing systems, overfilling and splash back often occurs resulting in fuel becoming trapped in the vapor recovery bellows of prior art boots causing subsequent fuel spillage. The normal fueling operation causes continuous repetitive deflection of the hinge points of the prior art bellows/boot designs. This repetitive hinging action prematurely deteriorates the device and reduces boot service life. As a consequence of the problems associated with closed, balanced systems, open type vapor recovery systems, which do not seal relative to the fuel pipe and which permit the ingestion of outside air during vapor recovery, have become the industry standard. Open systems, as well as some balanced systems, utilize a vacuum generating device to help draw vapor in and through the vapor recovery line.

Balanced systems principally rely on generating a negative pressure at the vapor recovery intake, relative to the pressure in the vehicle fuel tank, by sealing the fuel delivery spout relative to the fuel pipe. The inflow of liquid fuel into the fuel tank creates a positive pressure and displaces the fuel vapors. In balanced systems, vacuum generating devices merely provide assistance in overcoming the loss of pressure associated with long vapor return lines which can cause undesirable pressure build up in the automobile fuel tank. Unlike balanced systems, the vacuum generating devices of open systems generally provide negative pressure at the vapor recovery intake. The open system derives its name from the fact that no seal is required between the nozzle spout and the vehicle fuel pipe. Accordingly, no "donut" seal or "bellows" type boot is required for the effective operation of an open system. Because no seal is used, open vapor recovery systems may draw in ambient air into the vapor return line during vapor recovery.

While the present invention provides beneficial use in balanced systems, such as disclosed in U.S. Pat. No. 4,166,485(Wokas), it is particularly useful in vacuum-assisted fuel vapor recovery systems. In such vacuum-assisted systems, a motor operated vacuum pump is placed in the fuel vapor recovery line so as to actively draw in escaping fuel vapor into the recovery line during vehicle fuel tank refueling. To enhance vacuum-assisted vapor recovery system operation, a device is needed to "trap" or contain the escaping vapors and limit the amount of outside air ingested into the vapor recovery system during the refueling process.

SUMMARY OF THE INVENTION

The present invention provides a means for trapping a substantial amount of escaping fuel vapor during vehicle fuel tank refueling and a means for providing splash back protection in the event of fuel tank overfilling. The invention in its preferred embodiment is bell-shaped and is of one-piece construction having a neck flange connected to an annular forward biased fuel vapor entrapment housing which terminates in an annular ring. The neck flange provides a means for securing the fuel vapor entrapment device to the fuel dispensing nozzle spout. The annular fuel vapor entrapment housing is forward biased and otherwise structured so as to encircle the vehicle fuel tank filling port when the fuel dispensing nozzle spout is disposed inside the vehicle tank filler neck during refueling. During fueling operations, the annular ring may engage with the vehicle filler neck back plate or the annular housing may engage with the fuel fill port. By encircling the vehicle fuel tank filler port, the fuel recovery device entraps the escaping fuel vapor and prevents it from leaking into the atmosphere during vacuum assisted vapor recovery. A relief vent hole is provided in the fuel vapor entrapment device to allow sufficient ingestion of outside air during vacuum-assisted vapor recovery to prevent the occurrence of a substantial seal at the fill pipe so as to prevent fuel tank collapse. The relief vent hole additionally provides an escape means for liquid fuel collected in the fuel vapor entrapment device in the event of fuel tank overfilling.

One advantage of the present invention is that it is designed to avoid the use of predetermined hinge points or bellows, so as to prevent undesired entrapment of liquid fuel in the event of overfilling and to provide enhanced device service life.

Another advantage of the present invention is the use of a vent hole to permit the ingestion of sufficient ambient air into the fuel vapor entrapment chamber so as to preclude the development of excessive negative pressure therein, thereby preventing vehicle fuel tank collapse during vacuum-assisted vapor recovery.

A further advantage of the present invention is its bell-like structural design which lacks a vapor recovery bellows and provides enhanced endurance and an extended useful life.

Yet another advantage of the present invention is its ability to provide splash back protection without entrapping the splashed liquid fuel and allow the escape of such splashed liquid fuel in the event of fuel tank overfilling.

Still another advantage of the present invention is its ability to prevent excess air from being ingested into the system while allowing a sufficient amount of outside air into the system to prevent vehicle fuel tank collapse.

In one form of the invention, a fuel vapor entrapment device is provided having a resilient conically shaped housing including a smaller first end and a larger second end. The smaller first end connects the fuel vapor entrapment device to a liquid fuel dispensing nozzle. The larger second end opens outwardly in the same direction as the fuel dispensing nozzle. The fuel entrapment device is provided with a relief hole formed in the second end to permit the flow of ambient air into said housing during fuel vapor recovery so as to prevent the collapse of the vehicle fuel tank. The fuel vapor entrapment device is used in association with a vacuum-assisted fuel vapor recovery system to trap escaping fuel vapor for recovery.

In another form of the invention, a fuel vapor entrapment device is provided having a neck flange with a slit to aid in slidably disposing the entrapment device onto a spout of a fuel dispensing nozzle. An annular clamping device is provided to secure the device to the nozzle spout. The vapor entrapment device has a bell-shaped structure which, when operably disposed about a vehicle fuel fill port during the fueling process, traps escaping fuel vapor, thereby assisting the vacuum-assisted vapor recovery system. A forward biased annular wall provides the bell-like shape and encircles the annular edge of the vehicle fill port to form a fuel vapor entrapment chamber. The entrapment device is provided with a vent hole through which ambient air is ingested. The vent hole prevents the build up of excessive negative pressure during vacuum-assisted vapor recovery, thereby preventing vehicle fuel tank collapse.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
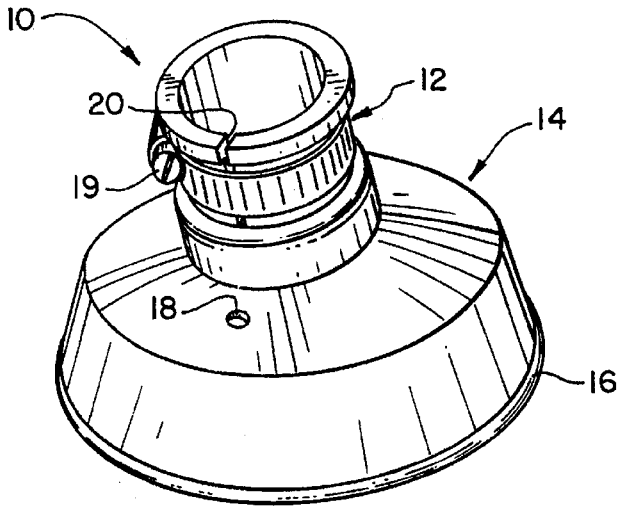
FIG. 1 is a rear perspective view depicting the preferred embodiment of the fuel vapor entrapment device of the present invention.

FIG. 1 illustrates fuel vapor recovery entrapment device 10 of the present invention in its preferred embodiment as a unitary structure made of urethane. Blow molding or injection molding are suggested methods of manufacturing, however, other means of manufacturing may also be satisfactory. Although urethane is described as being the preferred material used in forming the fuel vapor entrapment device, many different materials may be used provided such alternatives are compatible for use with liquid fuels, such as gasoline, and additionally provide the requisite level of flexibility. The material chosen should be of sufficient flexibility so that device 10 can effectively conform to the shape of the fuel fill port or fill port back plate when so engaged. However, the material chosen must provide sufficient rigidity so that device 10 will substantially maintain its original bell-shape configuration. Fuel vapor entrapment device 10 is formed having neck flange 12 connected with annular wall 14, which terminates into annular ring 16. Vacuum relief hole 18 and slit 20 are also provided. Clamp 19 encircles neck flange 12 and secures device 10 to fuel dispensing nozzle spout 22, as shown in FIG. 3.

Figure 2:
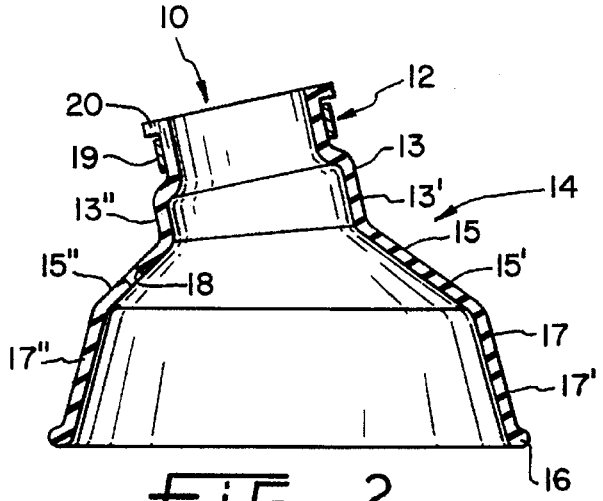
FIG. 2 is a cross sectional view of the fuel vapor entrapment device of FIG. 1.

FIG. 2 represents fuel vapor entrapment device 10 in cross section. Although slit 20 is shown as extending axially along the length of neck flange 12, it may be formed in any manner and have any length consistent with the purpose of permitting device 10 to slide onto a fuel dispensing nozzle. Annular wall 14 is shown having three forward biased annular subwalls 13, 15, and 17, wherein subwall 17 terminates in annular ring 16. Each annular subwall 13, 15, and 17 has a front face 13', 15', and 17' and a rear face 13", 15", and 17". In the preferred embodiment of FIG. 2, device 10 is shown having a forward biased bell-shape, the body of which begins with tubular neck flange 12 and extends radially outwardly throughout annular wall 14. The length of first annular subwall 13 is longer at front face 13' than at rear face 13". With respect to the radial axis associated with neck flange 12, the radial angle of divergence of annular subwall 15 is greater at front face 15' than at rear face 15". The length of second annular subwall 15 is longer at front face 15' than at rear face 15". In this configuration, when the fuel nozzle is disposed inside a vehicle tank filler neck during refueling operation, device 10 completely encircles the fuel fill port, prevents the excessive ingestion of ambient air, and deflects and entraps escaping fuel vapors. By substantially encircling the fuel fill port, device 10 prevents the excessive ingestion of ambient air into the vapor recovery system.

Vent relief hole 18 is provided in fuel vapor entrapment device 10 to insure proper ambient air relief during vacuum-assisted fuel vapor recovery. Relief hole 18 is sized so as to prevent the excessive ingestion of ambient air, which would diminish system capacity, while permitting the ingestion of a sufficient amount of ambient air to prevent sealing of the vapor return system and vehicle fuel tank collapse during vacuum-assisted vapor recovery.

Figure 4:
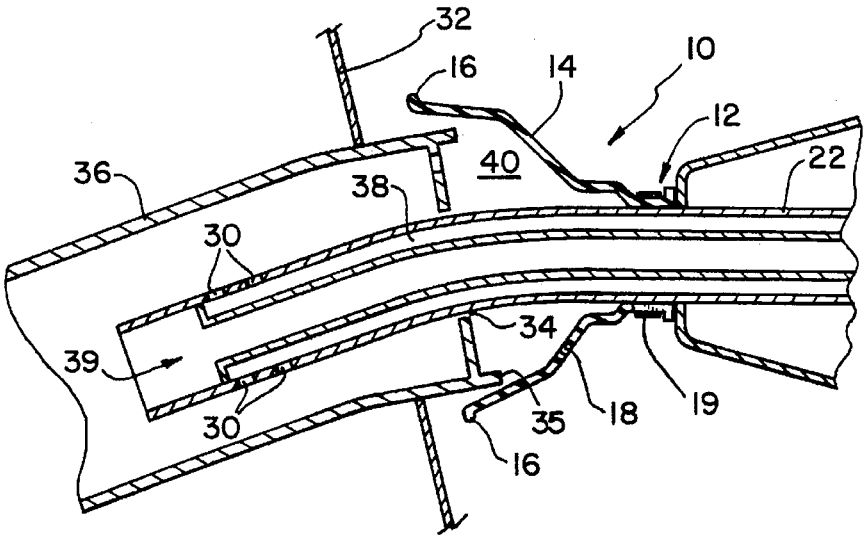
FIG. 4 is an enlarged cross sectional view of the vapor recovery device of FIG. 1 secured to a fuel dispensing nozzle spout disposed in a tank filler neck during a fueling operation.
Figure 3:
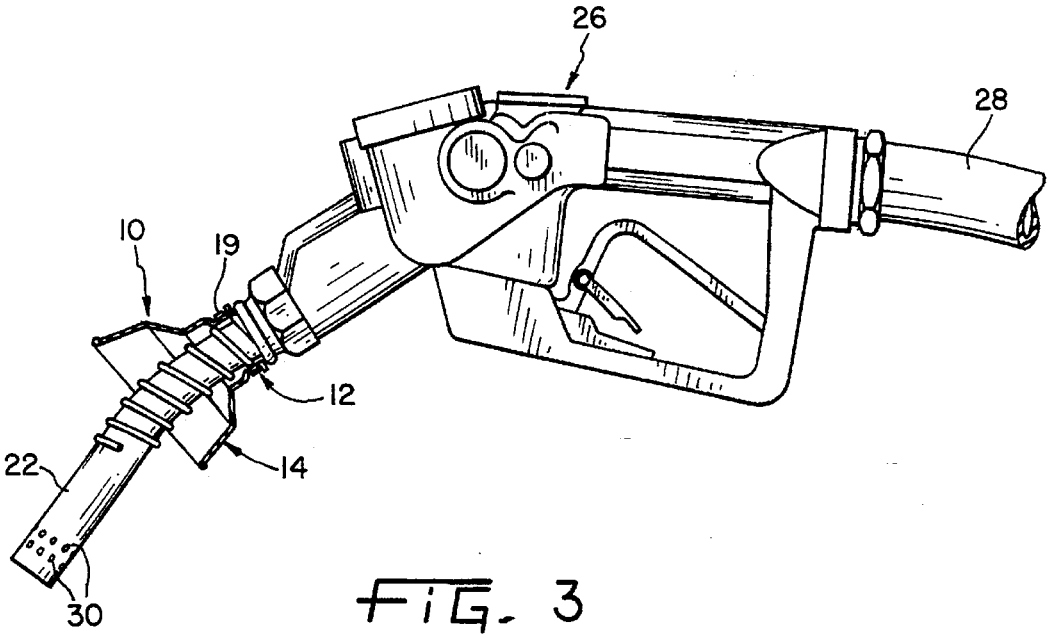
FIG. 3 is a cross sectional view of the fuel vapor entrapment device of FIG. 1 secured to a typical vapor recovery equipped fuel dispensing nozzle.

Fuel vapor entrapment device 10 is slidably disposed onto fuel nozzle spout 22 and over spout ring 24 as shown in FIG. 3. Fuel dispensing nozzle 26 is illustrated as having a coaxial nozzle spout 22 and connected to fuel delivery hose 28. Coaxial nozzle spout 22 has an inner fuel dispensing tube 39, as shown in FIG. 4, an outer annular fuel vapor recovery passage 38, as shown in FIG. 4, and fuel vapor recovery intake holes 30. Fuel dispensing nozzle 26 provides communication between fuel delivery hose 28 and nozzle spout 22 for delivering liquid fuel into motor vehicle fuel tanks. Fuel dispensing nozzle 26 also provides communication between outer annular fuel vapor recovery passage 38 and a fuel vapor communication line associated with hose 28. In its preferred embodiment, the present fuel vapor entrapment device is secured to the coaxial spout of a vapor recovery nozzle such as manufactured by Husky Corporation of Pacific, Mo. or Ohio Pattern Works of Cincinnati, Ohio.

Figure 5:
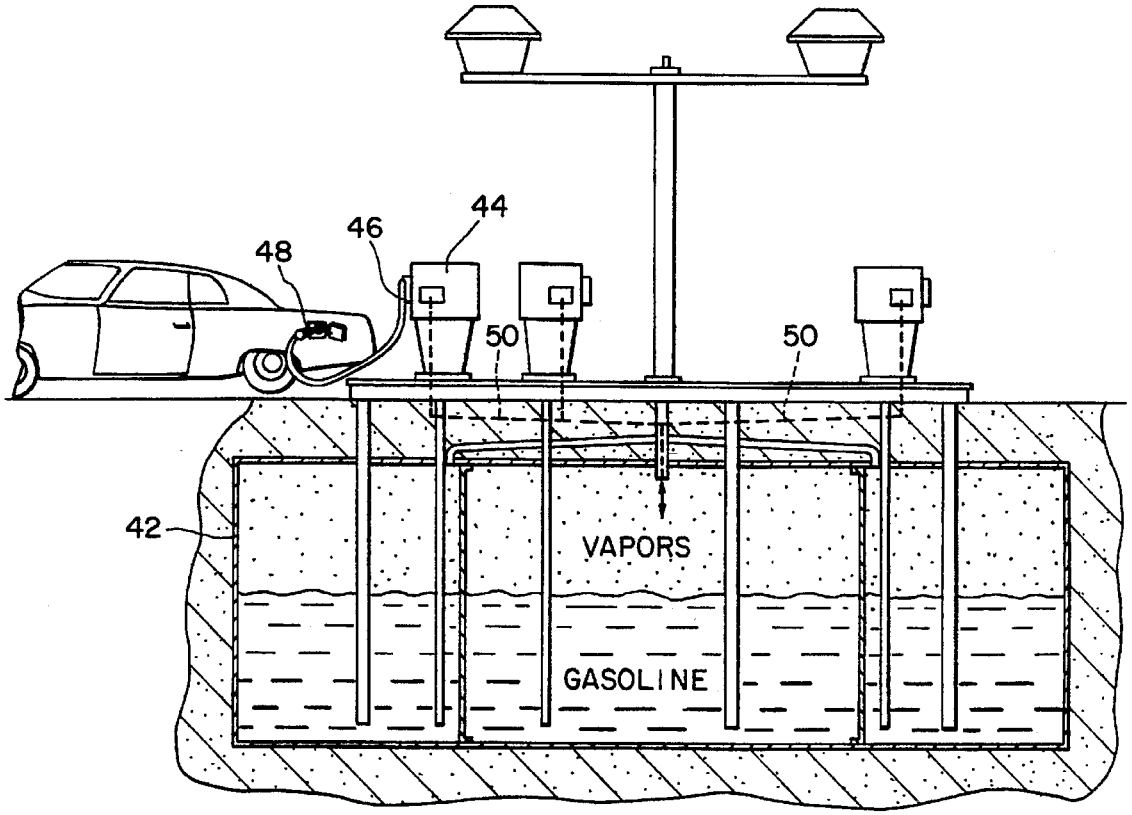
FIG. 5 is a fragmentary view of a vapor recovery system utilized in a typical motor vehicle fuel filling station.

FIG. 4 illustrates fuel vapor entrapment device 10 as utilized during motor vehicle tank refueling and vapor recovery operation. Fuel vapor entrapment device 10 is secured to nozzle spout 22 at neck flange 12 by clamp 19 and is shown adjacent to and substantially encircling filler port 34. Fuel vapor entrapment device 10 may engage filler neck back plate 32 at annular ring 16. During the refueling process, nozzle spout 22 is introduced through fuel tank filler port 34 and into fuel tank filler neck 36, wherein fuel is delivered from fuel dispenser 44, as shown in FIG. 5, and into the vehicle fuel tank.

A problem associated with prior art fuel tank refueling systems which lack a vapor recovery apparatus is the expulsion of fuel vapor during tank refueling. As the vehicle fuel tank is filled with liquid fuel, the liquid fuel level rises and fuel vapors are displaced and forced out of the tank. The escaping fuel vapors are forced through tank filler neck 36, through filler port 34 and exhausted into the atmosphere.

Fuel vapor entrapment device 10, as shown in FIG. 4 in cooperation with an open type vacuum-assisted fuel vapor recovery system, helps prevent fuel vapors from escaping into the atmosphere and aids in fuel vapor recovery. When fuel vapor entrapment device 10 encircles the outer annular edge of filler port 34, escaping fuel vapors are trapped and deflected and prevented from escaping. With a vacuum-assisted vapor recovery system in operation, escaping fuel vapors are drawn into fuel vapor recovery intake holes 30 and communicated through outer annular fuel vapor recovery passage 38, through the vacuum pump mechanism associated with fuel dispenser 44, through a fuel vapor communication system and into a fuel vapor storage tank.

When fuel vapor entrapment device 10 encircles filler port 34, a fuel vapor entrapment chamber 40 is formed (FIG. 4). Vacuum relief hole 18 is provided to prevent annular ring 16 from creating a substantially air-tight seal with filler neck backplate 32 and from generating an excessive negative pressure condition during vacuum-assisted vapor recovery. Alternatively, annular wall 14 may engage with annular fill port edge 35. Again, vacuum relief hole 18 prevents the occurrence of a substantially air-tight seal at filler port 34 and thereby prevent an excessive negative pressure condition from occurring during vacuum-assisted vapor recovery. If an excessive level of negative pressure were allowed to develop, the vehicle fuel tank could potentially collapse. Vacuum relief hole 18 permits sufficient ambient air intake into fuel vapor entrapment chamber 40 to prevent collapse of the vehicle fuel tank during vacuum-assisted vapor recovery. In essence, fuel entrapment device 10 is positioned on nozzle spout 22 such that on insertion of nozzle spout 22 into vehicle filler neck 36, the vehicle entrapment device forms a fuel vapor containment area 40. In this manner, escaping fuel vapors are trapped and reclaimed by the vapor recovery system.

It should be noted that vapor entrapment device 10 does not ever seal the vapor recovery system so as to form a closed system. Rather, the vapor entrapment device deflects the vapors and helps to prevent their escape to the atmosphere to facilitate their capture by the vapor recovery system. If the vapor entrapment device conforms to the shape of the automobile fuel pipe or back plate, relief hole 18 prevents a seal from being established.

In the event of vehicle fuel tank overfilling, annular wall 14 provides splash back protection from escaping liquid fuel, while relief hole 18 permits the escape of splashed liquid fuel collected in fuel vapor entrapment chamber 40.

In the preferred embodiment, fuel vapor entrapment device 10 is constructed of a flexible material, such as urethane, which provides sufficient flexibility to allow the fuel entrapment device to conform to either filler neck back plate 32 or annular edge 35 of filler port 34. Device 10 thereby forms an effective fuel vapor containment area when encircling annular fill port edge 35. The shape of fuel entrapment device 10 is nominally optimized to provide sufficient rigidity in the generally flexible urethane type material so as to maintain the required form to envelop the vehicle fuel fill port and form vapor entrapment chamber 40.

The size, configuration and materials used in the design of the fuel vapor entrapment device are nominally optimized. However, modifications to any one or a combination thereof may be allowed without adversely effecting functionality of the fuel vapor entrapment device. In choosing the material and shape of device 10, there are competing factors which must be balanced, such as; 1) durability, 2) flexibility, 3) rigidity, 4) liquid fuel compatibility, 5) size of boot, 6) size of typical vehicle filler neck and nozzle receiving area, 7) cost of material, 8) molding process, 9) appearance, and 10) size of nozzle.

It is important to avoid the use of predetermined hinge points, bellows, or substantive refold creases in the design of fuel vapor entrapment device 10, as this would reduce product service life and result in the undesired entrapment of liquid fuel in the device in the event of tank overfilling.

In its preferred embodiment, as shown in the drawings and described herein, the structural design of fuel entrapment device 10 spreads the effects of articulation on the body of the device over a large area thereby minimizing stress cracking or fatiguing.

FIG. 5 illustrates a typical vacuum-assisted vapor recovery system incorporating the fuel vapor entrapment device. Liquid fuel is stored in liquid fuel storage tank 42. Fuel dispenser 44 retrieves the liquid fuel stored in liquid fuel storage tank 42 and provides fuel to fuel delivery hose 46. Fuel nozzle 48 is equipped with a fuel vapor entrapment device so that when nozzle spout 22 of fuel nozzle 48, as shown in FIG. 4, is disposed in the vehicle tank filler neck, the fuel vapor entrapment device operates as shown in FIG. 4 and as described above. A fuel vapor vacuum pump associated with fuel dispenser 44 draws entrapped fuel vapor into outer annular fuel vapor recovery passage 38 of fuel nozzle spout 22, as shown in FIG. 4, and sends the captured fuel vapor through a fuel vapor communication line associated with hose 28, through fuel dispenser 44, through fuel vapor recovery line 50, and delivers the fuel vapor into liquid fuel storage tank 42, which in one form may provide fuel vapor storage. Alternatively, there may exist a vapor storage tank separate from fuel storage tank 42.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuel vapor entrapment device for use in vacuum-assisted fuel vapor recovery systems as used in vehicle fuel tank fueling, the fuel vapor recovery system including a fuel dispensing nozzle and a nozzle spout, a vehicle fuel tank including a tank filler neck, a filler neck backplate, and a fuel fill port, said entrapment device comprising:

an annular neck flange for receiving the fuel nozzle spout, said neck flange having an inner neck diameter sized for tight-fit mating with the fuel nozzle spout, said neck flange adapted to slidingly dispose said fuel vapor entrapment device onto a said fuel nozzel spout;

a bell-shaped entrapment housing formed by a radially extending forwardly biased annular wall, said annular wall extending from said neck flange to a terminating edge and defining an annular ring, said annular wall having a vacuum relief hole for permitting intake of ambient air during vacuum-assisted vapor recovery, thereby preventing collapse of the vehicle fuel tank; and said annular wall encircling the said vehicle fuel fill port upon insertion of said fuel nozzle spout into the said vehicle fuel fill port and the said tank filler neck, thereby deflecting and trapping fuel vapors escaping from the said vehicle fuel fill port during fueling to permit their removal to a vapor storage device, said annular wall providing splash back protection in the event of overfilling the said vehicle fuel tank, and wherein said annular wall comprises:

a front face;

a rear face;

a first annular subwall having increasing length from said rear face to said front face;

a second annular subwall having increasing length from said rear face to said front face, said first subwall extending from said neck flange and terminating in said second subwall; and a third annular subwall, said second subwall extending longitudinally and radially outwardly from said first subwall and terminating in said third subwall, said third subwall extending longitudinally and radially outwardly from said second subwall and terminating in said annular ring.

2. A vacuum-assisted vapor recovery system for use with a motor vehicle during vehicle fuel tank fueling, the vehicle having a vehicle fuel tank, a tank filler neck, a filler neck backplate, and a fuel fill port, said system a fuel dispenser;

a fuel nozzle;

a fuel delivery hose connecting to said fuel dispenser to said fuel nozzle;

a spout attached to said fuel nozzle for delivering fuel to the said vehicle fuel tank, said spout having a fuel dispensing passage and a fuel vapor recovery passage, said spout defining vapor recovery holes for ingesting fuel vapor;

a fuel vapor storage tank;

a fuel vapor vacuum pump means for assisting in the recovery of fuel vapor escaping from the said tank filler neck during vehicle fueling;

a vapor communication means connecting said fuel vapor recovery passage to said fuel vapor vacuum pump means, said fuel vapor storage tank receiving covering fuel vapor from said fuel vapor vacuum pump means;

a bell-shaped fuel vapor entrapment device connected to said fuel nozzle, said fuel vapor entrapment device comprising:

an annular neck flange for receiving said spout, said neck flange having an inner neck diameter sized for tight-first mating with the outer diameter of said spout, said neck flange adapted to slidingly dispose said fuel vapor entrapment device onto said spout;

a radially extending forwardly biased annular wall, said annular wall extending form said neck flange and terminating in an annular ring, said annular wall having a vacuum relief hole permitting intake of ambient air during vacuum-assisted vapor recovery; and said annular wall encircling the said vehicle fuel fill port on insertion of said fuel nozzle spout through the said vehicle fuel fill port and into the said tank filler neck, thereby deflecting and trapping fuel vapors escaping from the said vehicle fuel fill port during fueling to permit their removal to said fuel vapor recovery storage tank, said annular wall providing splash back protection in the event of overfilling the said vehicle fuel tank, and wherein said annular wall of said fuel vapor entrapment device comprises:

a front face;

a rear face;

a first annular subwall having increasing length from said rear face to said front face;

a second annular subwall having increasing length from said rear face to said front face, said first subwall extending from said neck flange and terminating in said second subwall; and a third annular subwall, said second subwall extending longitudinally and radially outwardly from said first subwall and terminating in said third subwall, said third subwall extending longitudinally and radially outwardly from said second subwall and terminating in said annular ring.

3. A fuel vapor entrapment device for use in vacuum-assisted fuel vapor recovery systems as used in vehicle fuel tank fueling, a vehicle fuel tank having a tank filler neck, a filler neck backplate, and a fuel fill port, said device being bell-shaped and comprising:

an annular neck flange adapted to cooperate with and attach to a fuel nozzle spout, said neck flange having an inner neck diameter sized for tight-fit mating with the said fuel nozzle spout, said neck flange having a slit to aid in slidingly disposing said fuel vapor entrapment device onto the said fuel nozzle spout;

a radially extending forwardly biased annular wall, said annular wall comprising a front face, a rear face, a first annular subwall having increasing length from said rear face to said front face, a second annular subwall having increasing length from said rear face to said front face, a third annular subwall, one of said first, second and third subwalls defining a relief hole permitting intake of ambient air during vacuum-assisted vapor recovery;

said first subwall extending from said neck flange and terminating in said second subwall; said second subwall extending longitudinally and radially outwardly from said first subwall and terminating in said third subwall, said third subwall extending longitudinally and radially outwardly from said second subwall and terminating in an annular ring; and said annular wall encircling the said vehicle fuel fill port on insertion of the said fuel nozzle spout through the said vehicle fuel fill port and into the said tank filler neck, thereby deflecting and trapping fuel vapors escaping from the said vehicle fuel fill port during fueling to permit their removal to a vapor storage device, said annular wall providing splash back protection in the event of overfilling the said vehicle fuel tank.

4. The fuel vapor entrapment device of claim 3, further comprising a clamping means for securing said neck flange about said fuel nozzle spout.

5. The fuel vapor entrapment device of claim 3, wherein said slit extends along the length of said neck flange.

6. The fuel vapor entrapment device of claim 3, wherein said relief hole is located to permit the escape of liquid fuel enclosed by said vapor entrapment device in the event of overfilling the said vehicle tank.

7. The fuel vapor entrapment device of claim 3, wherein said device is formed of urethane.

* * * * *